US008186422B2

(12) United States Patent
Hennig et al.

(10) Patent No.: US 8,186,422 B2
(45) Date of Patent: May 29, 2012

(54) METHOD FOR THE CONTINUOUS CASTING OF THIN METAL STRIP AND CONTINUOUS CASTING INSTALLATION

(75) Inventors: Wolfgang Hennig, Neuss (DE); Holger Beyer-Steinhauer, Mettmann (DE); Christian Bilgen, Düsseldorf (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 319 days.

(21) Appl. No.: 12/086,523

(22) PCT Filed: Nov. 27, 2006

(86) PCT No.: PCT/EP2006/011339

§ 371 (c)(1),
(2), (4) Date: Jan. 12, 2009

(87) PCT Pub. No.: WO2007/068338

PCT Pub. Date: Jun. 21, 2007

(65) Prior Publication Data

US 2009/0199391 A1 Aug. 13, 2009

(30) Foreign Application Priority Data

Dec. 14, 2005 (DE) ..... 10 2005 059 692

(51) Int. Cl.

| | |
|---|---|
| ***B22D 11/12*** | (2006.01) |
| ***B22D 11/128*** | (2006.01) |
| ***B21B 1/46*** | (2006.01) |

(52) U.S. Cl. ..... 164/476; 164/484; 164/417; 164/442; 29/527.7

(58) Field of Classification Search ..... 164/417, 164/476, 442, 484; 29/527.7
See application file for complete search history.

(56) References Cited

U.S. PATENT DOCUMENTS 6,491,088 B1 * 12/2002 Sucker et al. ..... 164/454

FOREIGN PATENT DOCUMENTS

| | | |
|---|---|---|
| DE | 198 17 034 | 10/1999 |
| EP | 1 033 190 | 9/2000 |
| EP | 1 071 529 | 1/2001 |
| GB | 766 584 | 1/1957 |
| WO | 2004/065030 | 8/2004 |

* cited by examiner

*Primary Examiner* — Kevin P Kerns
(74) *Attorney, Agent, or Firm* — Lucas & Mercanti, LLP; Klaus P. Stoffel

(57) ABSTRACT

A method for the continuous casting of thin metal strip in a continuous casting installation, in which metal is discharged vertically downward from a mold, the metal strip is deflected from the vertical direction to the horizontal direction, and the metal strip is supported and/or conveyed and/or plastically deformed by a number of pairs of drive rolls. At least one pair of drive rolls plastically deforms the metal strip without significantly changing the mean thickness of the metal strip, namely with a change in the mean thickness of the metal strip of less than 5%, such that the deformation in the pairs of drive rolls produces material flow exclusively in the direction transverse to the direction of conveyance of the metal strip.

7 Claims, 2 Drawing Sheets

METHOD FOR THE CONTINUOUS CASTING OF THIN METAL STRIP AND CONTINUOUS CASTING INSTALLATION

BACKGROUND OF THE INVENTION

The invention concerns a method for the continuous casting of thin metal strip in a continuous casting installation, in which metal is discharged vertically downward from a mold, the metal strip is deflected from the vertical direction to the horizontal direction, and the metal strip is supported and/or conveyed and/or plastically deformed by means of a number of pairs of drive rolls. The invention also concerns a continuous casting installation, especially for carrying out the method of the invention.

A method of this general type is known from EP 1 071 529 B1 and WO 2004/065030 A1. In the continuous casting of thin metal strip, liquid metal is fed from above to a mold, from which the preformed metal strip with a still liquid core emerges vertically downward. The strip cools off and solidifies in the direction of conveyance, and as it moves, it is gradually deflected from the vertical direction to the horizontal direction. Several pairs of drive rolls, which support and convey the strip, are provided for this purpose. Provision can also be made for the pairs of drive rolls to carry out a preliminary deformation of the metal strip, i.e., the metal strip is reduced in thickness. After passing through the pairs of drive rolls, the strip then enters a downstream rolling mill, in which the strip is rolled out further.

CSP refers to a combined casting and rolling process for thin slabs with thicknesses that are usually 45-70 mm but occasionally up to 90 mm. The requirements that are being placed on the dimensional stability of the geometry and the mechanical properties of the finished hot-rolled strip are steadily increasing. At the same time, market demand for hot-rolled strip with the least possible final thickness is also rising. The thinner the hot-rolled strip is to be rolled out in the finishing train, the more difficult it is to control the rolling process. The requirements on the control and adjustment systems in the finishing train increase considerably at final thicknesses below 1.5 mm.

The geometry of the slab that is entering the finishing train also has a significant influence on the stability of the rolling process, especially with respect to the profile and thickness taper of the thin slab over the width of the metal strip and its uniformity over the length of the slab. Abrupt changes in the profile or the thickness taper over the length lead to abrupt changes in the state of flatness within the finishing train and thus to instabilities during rolling, which in unfavorable cases can result in strip folding with loss of production (discontinuation of casting). The slab geometry is a direct quality-determining result of the casting process. In accordance with the prior art, there is only the possibility of realizing a certain amount of thickness reduction in the area of the pairs of drive rolls by the rolling process between the drive rolls.

In the prior art, CSP casting machines are furnished with liquid core reduction (LCR) and offer the possibility of altering the thickness taper of the metal strip or the thin slab by means of position-controlled hydraulic cylinders. The profile of the thin slab depends on the rigidity of the segments and the position of the tip of the liquid crater. The deeper the tip of the liquid crater is located in the casting machine, the greater is the ferrostatic pressure and thus, at a presumed constant segment rigidity, the greater is the deflection of the segments and the thin slab profile that develops. In practice, this means that a change in the casting speed changes the position of the tip of the liquid crater, and consequently an altered slab profile is obtained. In addition, the slab profile can be negatively affected by the wear profile of the segment rollers. This effect or this change can lead to considerable difficulties in the subsequent rolling process.

In any case, previously used CSP casting machines generally did not have liquid core reduction. This means that neither the profile nor the thickness taper of the thin slab could be influenced. In this case, the slab geometry depends on the orientation of the segments relative to one another, on the rigidity of the segments, and, finally, on the position of the tip of the liquid crater. Therefore, in casting machines without liquid core reduction, the problems to be expected in the rolling mill are correspondingly greater.

Therefore, so far there has been no possible means in the CSP process by which the geometry of the thin slab can be improved and held constant for the purpose of creating reproducible conditions for the rolling of the metal strip in the rolling mill.

SUMMARY OF THE INVENTION

Therefore, the objective of the invention is to create a method and a corresponding continuous casting machine with which the aforementioned disadvantages can be overcome. The goal is thus to ensure that optimum conditions are present for producing a high-quality metal strip during the rolling process that takes place downstream of the continuous casting installation.

With respect to the method, in accordance with the invention, the solution to this problem is wherein at least one pair of drive rolls plastically deforms the metal strip without significantly changing the mean thickness of the metal strip.

The method is preferably executed in such a way that the one or more pairs of drive rolls eliminate all or most of any wedging of the metal strip that may be present in the width direction of the strip. Alternatively or additionally, it can be provided that the one or more pairs of drive rolls produce a desired cross-sectional profile of the metal strip. In addition, an effort is made to ensure that the deformation in the pairs of drive rolls produces material flow exclusively or at least largely in the direction transverse to the direction of conveyance of the metal strip.

It is advantageous for the deformation without significant change in the mean thickness to take place in the last pair, the last two pairs, or the last three pairs of drive rolls in the direction of conveyance of the metal strip. Furthermore, this deformation takes place immediately before or after the deflection of the metal strip into the horizontal direction. Specifically, it is provided that the deformation without significant change in the mean thickness takes place in the pairs of drive rolls immediately before the deformation that takes place in a rolling mill that is downstream of the casting installation in the direction of conveyance of the metal strip.

In particular, the aforesaid deformation of the metal strip without significant change in its mean thickness is understood to mean that the mean thickness of the metal strip by the last pair, the last two pairs, or the last three pairs of drive rolls at the end of the continuous casting installation is less than 5% and preferably less than 3%.

The proposed continuous casting installation for the continuous casting of thin metal strip consists of a mold, from which metal is discharged vertically downward, means for deflecting the metal strip from the vertical direction to the horizontal direction, and several pairs of drive rolls for supporting, conveying, and/or plastically deforming the metal strip. In accordance with the invention, as explained above, the continuous casting installation is characterized by at least one pair of drive rolls for plastically deforming the metal strip without significantly changing the mean thickness of the strip.

The proposal of the invention allows systematic adjustment of the geometry of a thin slab, by which is meant especially adjustment of the profile and the thickness taper.

Therefore, changes in the casting parameters, especially the casting speed, do not cause any changes in the slab contour. The pair of drive rolls or the last pairs of drive rolls with respect to the direction of conveyance can be reinforced in order to bring about the aforesaid plastic deformation without significant reduction of the thickness of the strip.

This results in constant conditions of strip run-in into the finishing train, thereby producing more stable rolling conditions, especially in the case of critical, i.e., thin, strip.

In particular, this makes it possible to improve both the profile and the thickness taper of a thin slab without permanently changing the thickness and the superficial microstructure of the metal strip. The material flow should occur only in the transverse direction and not in the longitudinal direction. Since thickness reduction is neither necessary nor desired, the straightening drive rolls can be realized with less expense, compared, for example, to the solution disclosed by WO 2004/065030 A1. Whereas the cited document describes a reducing pass (with significant reduction of the mean thickness of the strip), in accordance with the present invention, only a skin pass is carried out, which leaves the mean thickness of the strip largely unchanged but changes the profile of the metal strip. This improves the conditions for the subsequent thin strip rolling.

BRIEF DESCRIPTION OF THE DRAWING

The drawings illustrate a specific embodiment of the invention.

DETAILED DESCRIPTION OF THE INVENTION

Figure 1:
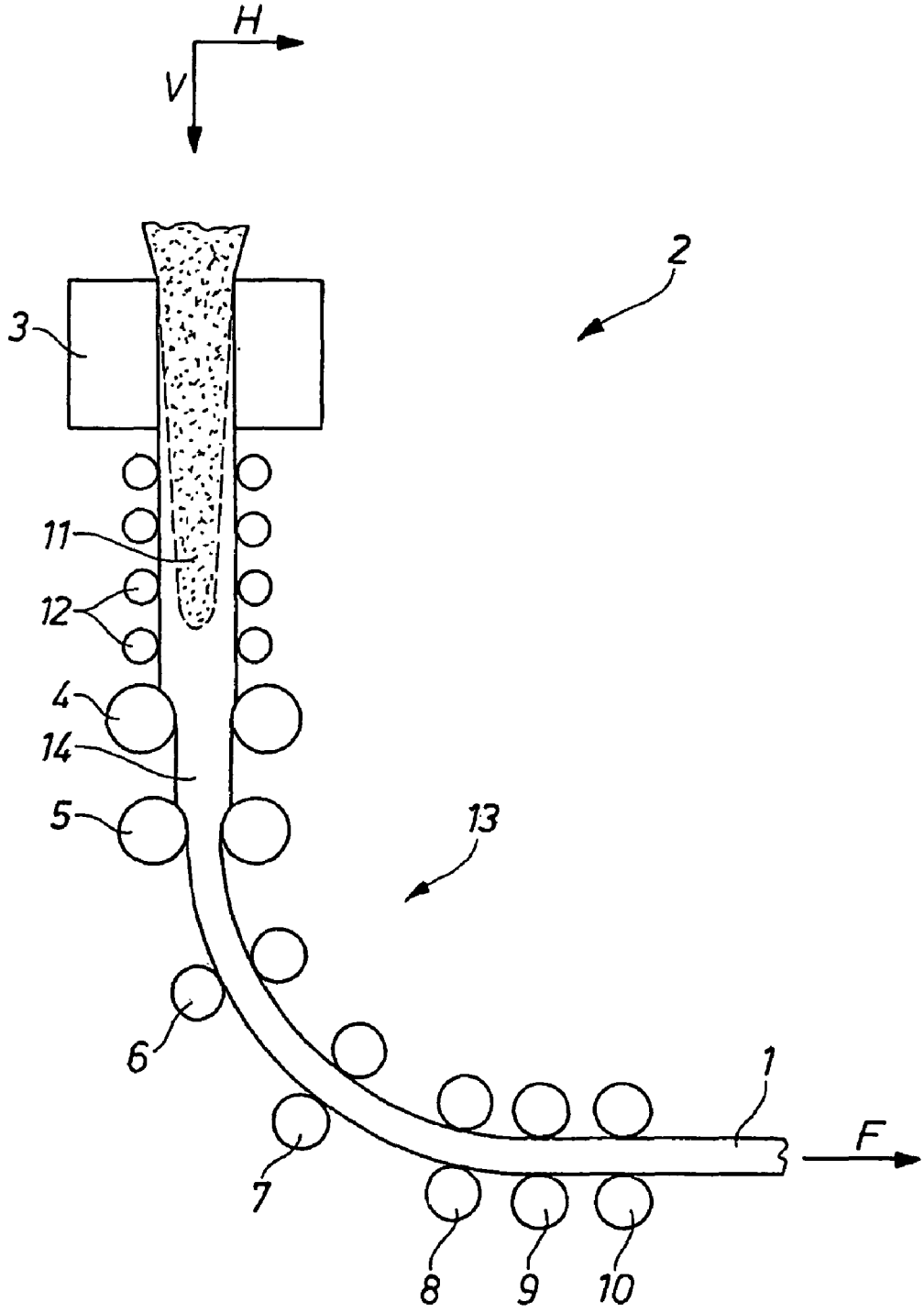
FIG. 1 is a schematic drawing of a continuous casting installation in a side view.

FIG. 1 shows a continuous casting installation 2, in which a metal strip 1 is produced. Liquid metal is fed from above into an oscillating mold 3. The metal strip 1 emerging vertically downward from the mold 3 has an inner core 11 that is still liquid. The core 11 gradually solidifies in the direction of conveyance F until the metal strip 1 is completely solid. The point of complete solidification is at 14 in FIG. 1.

Below the mold 3, the metal strip 1 is first guided vertically downward by means of a vertical strand guide 12, but then it is gradually deflected in the horizontal direction H by a number of rolls, only some of which are shown. This results in the formation of a casting arc 13.

Since very high temperatures are still present in the metal strip 1 at the point of complete solidification 14, the strip is still sufficiently soft to carry out controlled rolling of the metal strip 1 with pairs of drive rolls 4, 5, 6, 7, 8, 9, 10. Pairs of drive rolls as such are sufficiently well known in the prior art and serve the purpose of supporting, conveying, and rolling the metal strip 1 until it has been deflected into the horizontal direction H and is fed to a rolling mill (not shown) downstream of the last pair of drive rolls 10 in the direction of conveyance F.

The essence of the proposed idea is to provide an actuator with which the slab geometry can be influenced after the casting and solidification process of the thin slab, i.e., the metal strip 1. This task is to be carried out by the last pairs of drive rolls 8, 9, 10 of the continuous casting machine, which are located at the conveying end of the continuous casting machine. These pairs of drive rolls usually act as straightening rolls that straighten the metal strip into a level state. In the straightening drive roll before the shear (not shown) of the continuous casting machine, constant and low running speeds usually prevail, and the geometry with respect to profile and thickness taper that is established in the last pair of drive rolls undergoes no further change until the strip enters the finishing train. In accordance with the invention, the last pair of drive rolls or the last pairs of drive rolls 8, 9, 10—as viewed in the direction of conveyance F—are realized in such a way with respect to the pressures and forces that only minimal reduction of the thickness of the slab occurs. This minimal thickness reduction results in a corresponding transverse flow of material (material flow transverse to the direction of conveyance F), by means of which the profile and the thickness taper of the slab can be systematically adjusted.

Figure 2:
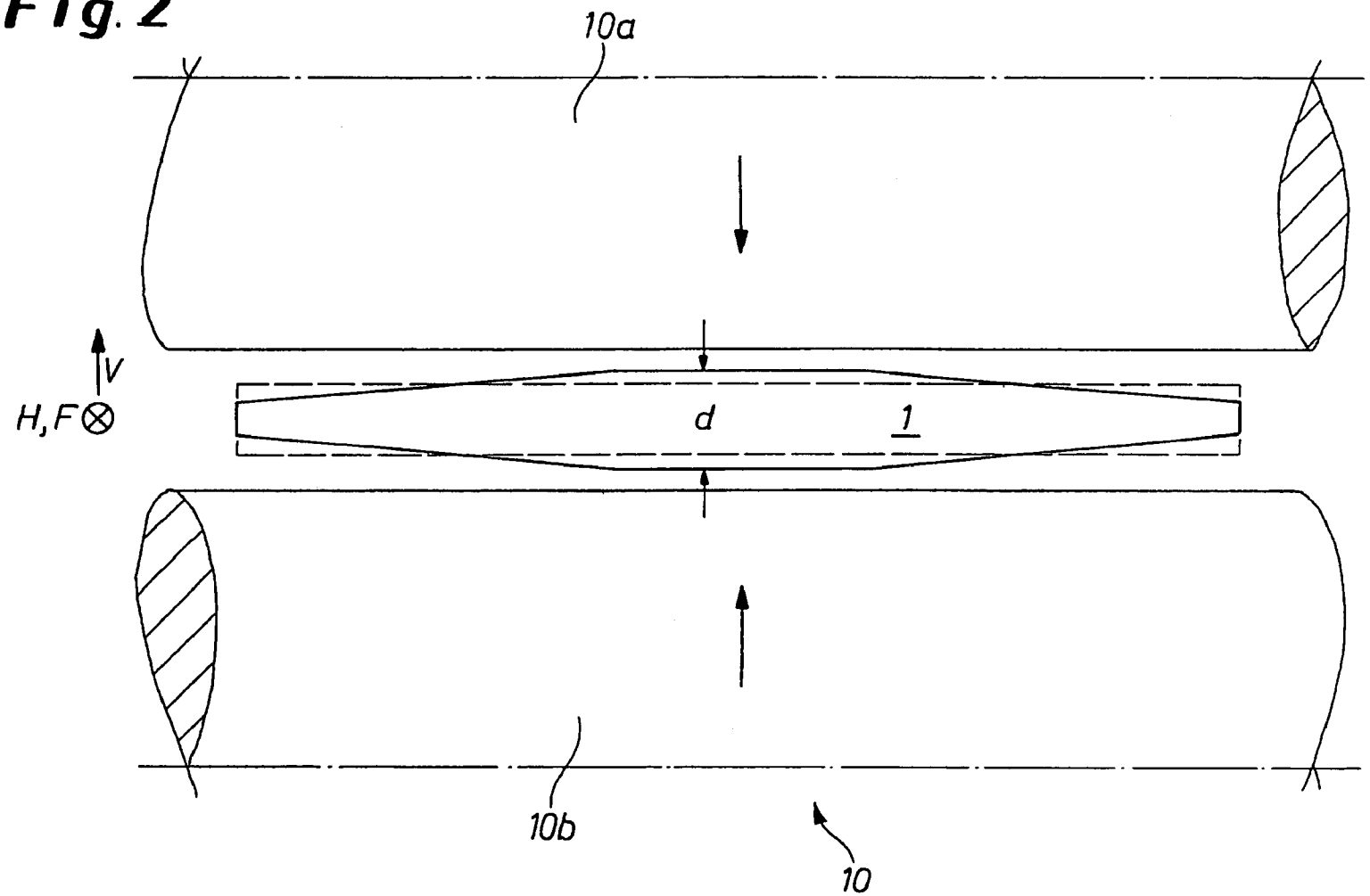
FIG. 2 is a schematic drawing of a pair of drive rolls, viewed in the direction of conveyance of the metal strip.

This is illustrated in FIG. 2, which shows a sketch of the cross section of the metal strip 1, i.e., the metal strip is viewed in the direction of its conveyance F. It is drawn with solid lines and with exaggeration. The two rollers 10*a* and 10*b* of the last pair of drive rolls 10 in the direction of conveyance F act on the two surfaces of the metal strip 1, as indicated by the arrows (for reasons of clarity, the rolls 10*a*, 10*b* are shown some distance from the metal strip 1).

The thickness d of the metal strip 1 is not constant across the width of the strip, but rather it is apparent that the strip has a high profile, which is undesirable and has a negative effect of the subsequent rolling process in the finishing train. Therefore, the rolls 10*a*, 10*b* are set in such a way that although there is no appreciable change in the mean thickness d of the metal strip, the excessive profile camber is eliminated, as indicated by the broken lines. The mean thickness is defined as the mean value of all values of the thickness d over the width of the metal strip 1.

It is known that during the operation of CSP continuous casting installations, a thin slab profile that has been ideally adjusted in the strand guide segments can be unfavorably altered in the subsequent drive rolls for bending and/or straightening. The most common reason for this is excessive wear of the drive rolls. Due to the high temperatures in the cast strand, even small drive roll forces are sufficient to produce lasting changes in the slab geometry. Therefore, the last pair of straightening drive rolls 10 is provided as the preferred site for the idea proposed by the invention, although it is also possible to use the last two or the last three pairs of drive rolls 8, 9, 10 for this purpose. However, it is already known in the prior art how to influence the slab geometry even before the straightening drive rolls 8, 9, 10. This leads to the disadvantages that were explained earlier. At any rate, the previously known measures provide for the improvement of the surface quality of the thin slab by a deformation of the slab, but improvement of dimensional stability is not the primary consideration.

In order to be able to adjust a constant profile, even under altered run-in conditions, such as different slab temperatures, the last pair of drive rolls 10 (or again the last three pairs of drive rolls 8, 9, 10) can be equipped with a roll bending system, which can maintain constant deflection of the drive rolls at any rolling force that is to be applied. Another possible means of systematic control is the provision of a hydraulically positioned counter roll, which presses against the middle of the drive roll with variable force, depending on the deflection of the drive roll. This guarantees that the deflection of the drive rolls can be kept constant.

Alternatively or additionally, the drive rolls can be provided with special profiling (CVC contour), and this would also make it possible, by the use of a shift system, to keep the profile of the slab constant and especially to eliminate wedging.

In any case, it is advantageous to provide the last pair of drive rolls 10 or the last two or last three pairs of drive rolls 8, 9, 10 with a hydraulic positioning system. This makes it easy to correct any wedging that may be present. In position-controlled adjustment, greater force is produced on the side with the greater thickness due to the greater reduction. The latter can produce a certain amount of slab cambering along the length under certain conditions. In this case, it is necessary to assess the extent to which this cambering can or should then be corrected. Earlier studies on this subject showed that cambering after the casting machine can be largely or at least partially equalized in the pusher furnace. With respect to possible residual cambering, it may be necessary to examine the extent to which this can lead to problems in the rolling mill.

It is advantageous to produce the greatest possible transverse material flow (material flow transverse to the direction of conveyance F) during the deformation in the straightening drive rolls. It can be stated that the greater the transverse flow is, the less will be the change in length and thus the less severe will be the subsequent cambering of the slab. The transverse flow can be favorably influenced with a larger roll diameter of the rolls of the pair of drive rolls and with higher friction between the slab and the roll.

Since higher stresses arise in the proposed straightening and shaping unit, especially in the last pair of drive rolls, the result is increased roll wear. One possible means of limiting this wear is to influence the slab geometry only in critical sequences (thin strip rolling). In all uncritical sequences, the mode of operation would be the same as in the prior art.

Further improvement with respect to the problem of roll wear can be realized by the use of on-line polishers (analogous to coiler drive rolls). The original roll contour can be continuously reground by individually adjustable segments (for example, by means of a torsion spring or flat spiral spring or by means of a pneumatic system). Worn edges in the roll contour can be avoided in this way.

In an exemplary calculation of roll deflection at a "rolling force" of 1,000 kN, a deflection per roll in the middle of the roll of 564 μm was obtained. With respect to the edge of a strand at a casting width of 1,400 mm, the deflection in the middle is about 270 μm. A profile of about 540 μm was thus obtained for the total roll gap.

LIST OF REFERENCE NUMBERS AND LETTERS

1 metal strip
2 continuous casting installation
3 mold
4 pair of drive rolls
5 pair of drive rolls
6 pair of drive rolls
7 pair of drive rolls
8 pair of drive rolls
9 pair of drive rolls
10 pair of drive rolls
**10*a*** roll of the pair of drive rolls
**10*b*** roll of the pair of drive rolls
11 liquid core
12 vertical strand guide
13 casting arc
14 point of complete solidification
V vertical direction
H horizontal direction
d thickness of the metal strip
F direction of conveyance

The invention claimed is:

1. A method for the continuous casting of thin metal strip (1) in a continuous casting installation (2), comprising the steps of: discharging metal vertically downward from a mold (3); deflecting the metal strip (1) from a vertical direction (V) to a horizontal direction (H); and supporting and/or conveying and/or plastically deforming the metal strip (1) by a number of pairs of drive rolls (4, 5, 6, 7, 8, 9, 10), at least one pair of drive rolls (8, 9, 10) being disposed after the deflection of the metal strip into the horizontal direction, wherein said at least one pair of drive rolls (8, 9, 10) plastically deforms the metal strip (1) after the metal strip is deflected into the horizontal direction, without significant change in a mean thickness (d) of the metal strip (1), said mean thickness being the mean value of all values of the thickness (d) over the width of the metal strip (1), to have a change in the mean thickness of less than 5%, such that the deformation in the pairs of drive rolls (8, 9, 10) produces material flow exclusively in a direction transverse to a direction of conveyance (F) of the metal strip (1) and such that a profile and a thickness taper of the metal strip are actively improved by eliminating all or most of any wedging of the metal strip (1) that may be present in the width direction thereof and held constant for a subsequent rolling process.

2. A method in accordance with claim 1, wherein the change in the mean thickness (d) of the metal strip (1) by the one or more pairs of drive rolls (8, 9, 10) is less than 3%.

3. A method in accordance with claim 1, wherein the one or more pairs of drive rolls (8, 9, 10) eliminate all or most of any wedging of the metal strip (1) that may be present in the width direction of the strip.

4. A method in accordance with claim 1, wherein the one or more pairs of drive rolls (8, 9, 10) produce a desired cross-sectional profile of the metal strip (1).

5. A method in accordance with claim 1, wherein the deformation without significant change in the mean thickness (d) takes place in the last pair of drive rolls (10), in the last two pairs of drive rolls (9, 10), or in the last three pairs of drive rolls (8, 9, 10) in the direction of conveyance (F) of the metal strip (1).

6. A method in accordance with claim 4, wherein the deformation without significant change in the mean thickness (d) takes place immediately after the deflection of the metal strip (1) into the horizontal direction (H).

7. A method in accordance with claim 5, wherein the deformation without significant change in the mean thickness (d) takes place in the pairs of drive rolls (8, 9, 10) immediately before the deformation that takes place in a rolling mill that is downstream of the casting installation in the direction of conveyance (F) of the metal strip (1).

* * * * *